US005945268A

United States Patent [19]

Daifuku et al.

[11] Patent Number: 5,945,268

[45] Date of Patent: Aug. 31, 1999

[54] SILVER HALIDE COLOR PHOTOGRAPHIC LIGHT-SENSITIVE MATERIAL

[75] Inventors: Koji Daifuku; Hiroyuki Yasukawa; Kohichi Takabe; Ryohei Iwamoto; Satoru Ikesu, all of Hino, Japan

[73] Assignee: Konica Corporation, Japan

[21] Appl. No.: 08/916,144

[22] Filed: Aug. 21, 1997

[30] Foreign Application Priority Data

Aug. 26, 1996 [JP] Japan ..... 8-223840

[51] Int. Cl.[6] ..... G03C 7/30

[52] U.S. Cl. ..... 430/551; 430/552; 430/553; 430/554; 430/555; 430/556; 430/557; 430/558; 430/559

[58] Field of Search ..... 430/552, 553, 430/551, 554, 555, 556, 557, 558, 559

[56] References Cited

U.S. PATENT DOCUMENTS 3,133,815 5/1964 Greenhalgh .
4,921,782 5/1990 Helling .

FOREIGN PATENT DOCUMENTS 5-323534 5/1992 Japan .

OTHER PUBLICATIONS

Search Report (European) EP 97 30 6478 with Annex Patent Abstracts of Japan Publication #05323534, Publication date: Jul. 12, 1993 (Abstract).

*Primary Examiner*—Janet Baxter
*Assistant Examiner*—Amanda C. Walke
*Attorney, Agent, or Firm*—Jordan B. Bierman; Bierman, Muserlian and Lucas

[57] ABSTRACT

Disclosed is a silver halide color photographic light sensitive material comprising a coupler represented by the following formula (I):
formula (I)

wherein Cp represents a coupler moiety; L represents a divalent linkage group; J represents —CO— or —$SO_2$—; $R_1$, $R_2$, $R_3$ and $R_4$ independently represent a hydrogen atom, an alkyl group or an aryl group, provided that one of $R_3$ and $R_4$ is a hydrogen atom; $R_5$ represents a substituent; and n represents 0 or 1.

8 Claims, No Drawings

SILVER HALIDE COLOR PHOTOGRAPHIC LIGHT-SENSITIVE MATERIAL

FIELD OF THE INVENTION

The present invention relates to a silver halide color photographic light sensitive material comprising a coupler having a novel ballast group.

BACKGROUND OF THE INVENTION

In a silver halide color photographic light sensitive material, as a method of adding couplers to a photographic emulsion, a method is useful which comprises the steps of dissolving a coupler, in which an oleophilic ballast group is introduced, in a high boiling solvent, adding the soluyion to a solution of a hydrophilic colloid represented by gelatin to obtain an emulsifying dispersion, and then adding the dispersion to the photographic emulsion.

A coupler is required to have the following fundamental properties. The coupler is to have high solubility in a high boiling point organic solvent, to have excellent dispersion and dispersion stability in a silver halide emulsion, which do not produce any precipitation, to give a dye image which has excellent spectral absorption property and good color tone, and is clear in a broad color reproduction region, to give a dye image having fastness to light, heat and humidity, and to be easily synthesized from cheap raw materials with high yield and with high reproduction.

The ballast group has great influence upon these photographic properties, and various ballast groups are proposed in Japanese Patent Publication Nos. 44-3660, 48-25655, 48-25932, 48-25934, 49-16057, and 51-40804, Japanese Patent O.P.I. Publication Nos. 47-4481, 49-8228, 50-19435, 51-126831, 52-86333, 56-30126, 57-146251, 58-42045, 59-177557, and 60-24547, and U.S. Pat. Nos. 2,908,573, 2,920,961 and 3,227,544.

However, these ballast groups are not sufficient to satisfy the above described properties.

SUMMARY OF THE INVENTION

A first object of the invention is to provide a silver halide color photographic light sensitive material which can provide sufficient color dye image density, a color dye image having excellent spectral absorption property, and a color dye image having excellent spectral absorption property even in a high density region.

A second object of the invention is to provide a silver halide color photographic light sensitive material comprising a coupler which can be easily synthesized from cheap raw materials with high yield and with good reproduction.

A fourth object of the invention is to provide a silver halide color photographic light sensitive material in which a formed dye image has excellent fastness to heat or humidity.

DETAILED DESCRIPTION OF THE INVENTION

The above object of the invention could be attained by the following constitution:

1. a silver halide color photographic light sensitive material comprising a coupler represented by the following formula (I):

formula (I)

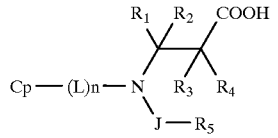

wherein Cp represents a coupler moiety; L represents a divalent linkage group; J represents —CO— or —$SO_2$—; $R_1$ through $R_4$ independently represent a hydrogen atom, an alkyl group or an aryl group; $R_5$ represents a substituent; and n represents 0 or 1, 2. the silver halide color photographic light sensitive material of item 1 above, wherein the coupler is represented by the following formula (II):

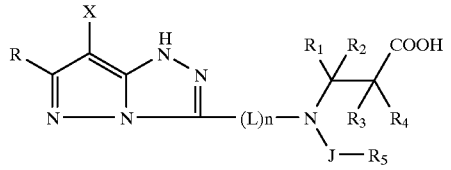

wherein L, J, $R_1$ through $R_5$, and n represent the same as L, J, $R_1$ through $R_5$, and n in formula (I), respectively; X represents a hydrogen atom or a group capable of being released upon reaction with an oxidation product of a color developing agent; and R represents a substituent, or 3. the silver halide color photographic light sensitive material of item 1 or 2, wherein one of $R_3$ and $R_4$ is a hydrogen atom.

Next, the invention will be explained in detail.

Cp in formula (I) represents a coupler moiety, and the coupler includes a yellow coupler, a magenta coupler and a cyan coupler. The typical yellow coupler is disclosed in U.S. Pat. Nos. 2,298,443, 2,407,210, 2,875,057, 3,048,194 and 3,447,928, and "Farbkupplereine Literaturbersiecht Agfa Mittilung (Band II)", p. 112–126 (1961).

Of these, an acylacetoanilide yellow coupler such as a benzoylacetoanilide coupler or a pivaloylacetoanilide coupler is preferable.

The typical magenta coupler is disclosed in U.S. Pat. Nos. 2,369,489, 2,343,703, 2,311,082, 2,600,788, 2,908,573, 3,062,653, 3,152,896, 3,519,429, 3,725,067, and 4,540,654, Japanese Patent O.P.I. Publication No. 59-162548, and "Farbkupplereine Literaturbersiecht Agfa Mittilung (Band II)", p. 126–156 (1961).

Of these, a pyrazolone or pyrazoloazole magenta coupler such as a pyrazoloazole magenta coupler or a pyrazolotriazole magenta coupler is preferable.

The typical cyan coupler is disclosed in U.S. Pat. Nos. 2,367,531, 2,423,730, 2,772,162, 2,895,826, 3,002,836, 3,034,892, and "Farbkupplereine Literaturbersiecht Agfa Mittilung (Band II)", p. 156–175 (1961).

Of these, a phenol type cyan coupler, a naphthol type cyan coupler, or a pyrazolotriazole cyan coupler is preferable.

Of coupler moieties represented by Cp in formula (I), pyrazolotriazole moieties are more preferable, and, of couplers represented by formula (I), couplers represented by formula (II) are especially preferable.

In formula (I), $R_1$ through $R_4$ independently represent a hydrogen atom, an alkyl group or an aryl group, provided that one of $R_3$ and $R_4$ is a hydrogen atom.

The alkyl group is preferably those having 1 to 16 carbon atoms, and may be straight-chained or branched. The typical alkyl group includes methyl, ethyl, and propyl, but is preferably an alkyl group having 1 to 4 carbon atoms, and more preferably methyl.

The aryl group includes phenyl, and the phenyl further has a substituent.

In formula (I), $R_1$ through $R_4$ represent preferably hydrogen atoms.

In formula (I), J represents —CO— or —$SO_2$—, and preferably —CO—.

In formula (I), L represents a divalent linkage group. The divalent linkage group is not specifically limited, and includes a divalent linkage group derived from an alkyl group, an aryl group, an anilino group, an acylamino group, a sulfonamido group, an alkylthio group, an arylthio group, an alkenyl group, a cycloalkyl group, a cycloalkenyl group, an alkinyl group, a heterocyclic group, a sulfonyl group, a sulfinyl group, a phosphonyl group, an acyl group, a carbamoyl group, a sulfamoyl group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclicthio group or a combination thereof. The preferable are a divalent linkage group derived from an alkyl group, an aryl group, an anilino group, an acylamino group, an acyloxy group, a sulfonamido group, a sulfonyl group, an acyl group, an amino group or a combination thereof, and the more preferable are a divalent linkage group derived from an alkyl group, an aryl group or a combination thereof.

n represents 0 or 1.

$R_5$ in formula (I) represents a substituent. The substituent represented by $R_5$ includes a straight-chained or branched alkyl group having 1 to 32 carbon atoms, an aryl group, a heterocyclic group, a spiro compound residue, and a closslinked hydrocarbon compound residue. The preferable are an alkyl or aryl group having 6 to 18 carbon atoms, which may further have the same substituent as R in formula (II) described later.

L, J, $R_1$ through $R_5$, and n in formula (II) is the same as L, J, $R_1$ through $R_5$, and n in formula (I), respectively, X represents a hydrogen atom or a group capable of being released upon reaction with an oxidation product of a color developing agent, and R represents a substituent.

In formula (II), R represents a hydrogen atom or a substituent.

The substituent represented by R is not specifically limited. The substituent includes alkyl, aryl, anilino, acylamino, sulfonamido, alkylthio, arylthio, alkenyl, cycloalkyl, a halogen atom, cycloalkenyl, alkynyl, heterocyclic, sulfonyl, sulfinyl, phosphonyl, acyl, carbamoyl, cyano, acyloxy, alkylamino, imido, ureido, sulfamoylamino, alkoxycarbonyl, aryloxycarbonyl, heterocyclicthio, spiro compound residues, and closslinked hydrocarbon compound residues.

The alkyl group represented by R includes a straight-chained or brancheded alkyl group having preferably 1 to 32 carbon atoms. The aryl group represented by R is preferably a phenyl group.

The acylamino group represented by R includes alkylcarbonylamino and arylcarbonylamino groups. The sulfonamido group represented by R includes alkylsulfonylamino and arylsulfonylamino groups.

The alkyl component and the aryl component of the alkylthio group and arylthio group represented by R correspond to the above alkyl groups and the aryl groups represented by R, respectively.

The alkenyl group represented by R may be either straight-chained or branched and includes those having 2 to 32 carbon atoms. The cycloalkyl group represented by R includes those having preferably 3 to 12 carbon atoms, more preferably 5 to 7 carbon atoms. The cycloalkenyl group represented by R includes those having preferably 3 to 12 carbon atoms, more preferably 5 to 7 carbon atoms.

The heterocyclic group represented by R is preferably a 5- to 7-membered cyclic group such as 2-furyl, 2-pyrimidinyl or 2-benzothiazolyl groups.

The sulfonyl group represented by R includes alkylsulfonyl and arylsulfonyl; the sulfinyl group includes alkylsulfinyl and arylsulfinyl; the phosphonyl group includes alkylphosphonyl and arylphosphonyl; the acyl group includes alkylcarbonyl and arylcarbonyl; the carbamoyl group includes alkylcarbamoyl and arylcarbamoyl; the sulfamoyl group includes alkyl sulfamoyl and arylsulfamoyl groups; the acyloxy group includes alkylcarbonyloxy and arylcarbonyloxy; the imido group includes succinic acid imido, 3-heptadecylsuccinic acid imido, phthalimido and glutarinido; the ureido group includes alkyl ureido and arylureido; the heterocyclic thio group is preferably a 5- to 7-membered heterocyclic thio group such as 2-pyridylthio or 2-benzothiazolylthio; the spiro compound residue includes a spiro[3.3]heptane-1-yl group; the crosslinked hydrocarbon compound residue includes bicyclo-[2.2.1]heptane-1-yl, tricyclo[3.3.1.13 7]decane-1-yl and 7,7-dimethyl-bicyclo [2.2.1]heptane-1-yl groups.

These groups may further have the substituents described above. Of these substituents are preferable alkyl, cycloalkyl, alkenyl, aryl, acylamino, sulfonamido, alkylthio, arylthio, a halogen atom, heterocyclic, sulfonyl, sulfinyl, phosphonyl, acyl, carbamoyl, sulfamoyl, acyloxy, alkylamino, imido, alkoxycarbonyl, aryloxycarbonyl, and ureido. The alkyl group is more preferable, and methyl is still more preferable.

The group represented by X capable of being released upon reaction with an oxidation product of a color developing agent includes a halogen atom such as chlorine, bromine or fluorine, and alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclicthio, alkoxycarbonylthio, acylamino, sulfonamido, N atom-bonded nitrogen-containing heterocyclic, alkoxycarbonylamino, aryloxycarbonylamino and carboxyl groups. The preferred among these are a hydrogen atom, a halogenm atom, alkoxy, aryloxy, heterocyclicoxy, alkylthio, arylthio, heterocyclicthio, and an N atom-bonded nitrogen-containing heterocyclic group. The more preferred is a halogen atom, and the still more preferred is a chlorine atom.

The exemplified compounds represented by formula (I) are listed below, but the invention is not limited thereto.

Y-1
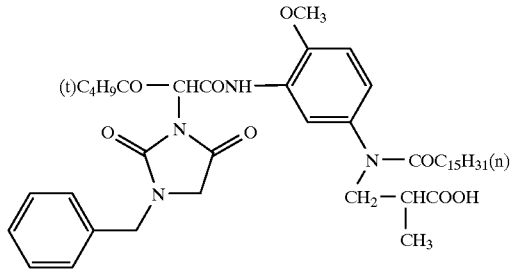
Y-2
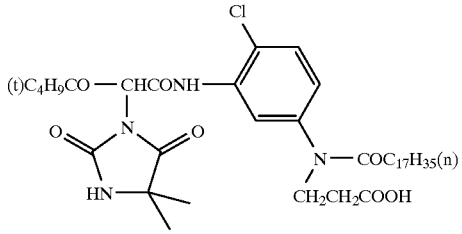
Y-3
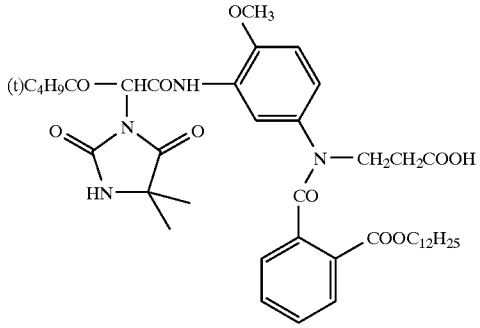
Y-4
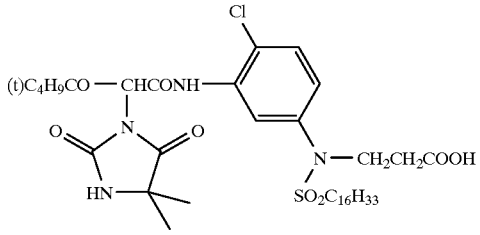
Y-5
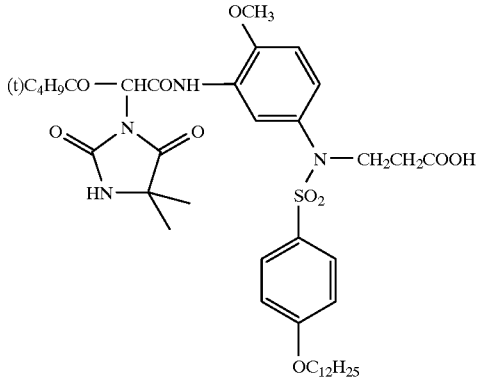

-continued
Y-6
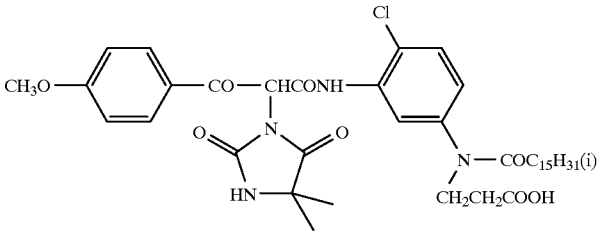
M-1
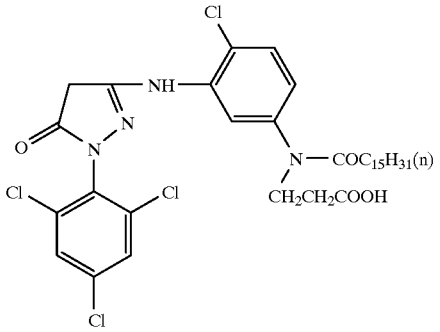
M-2
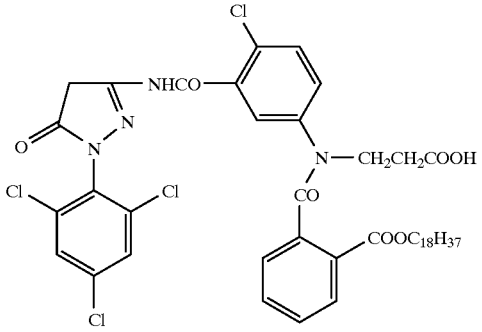
M-3
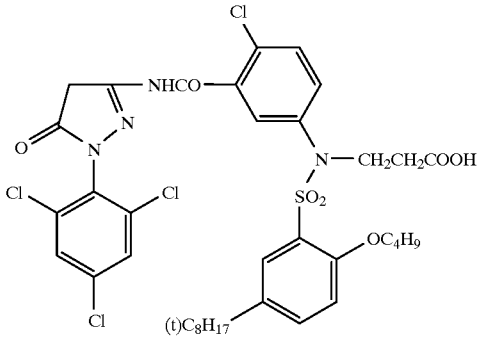
M-4
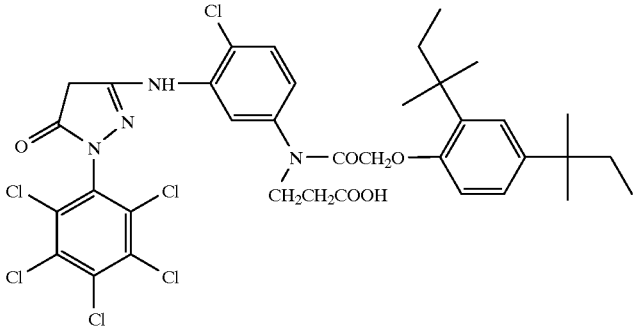

-continued
M-5
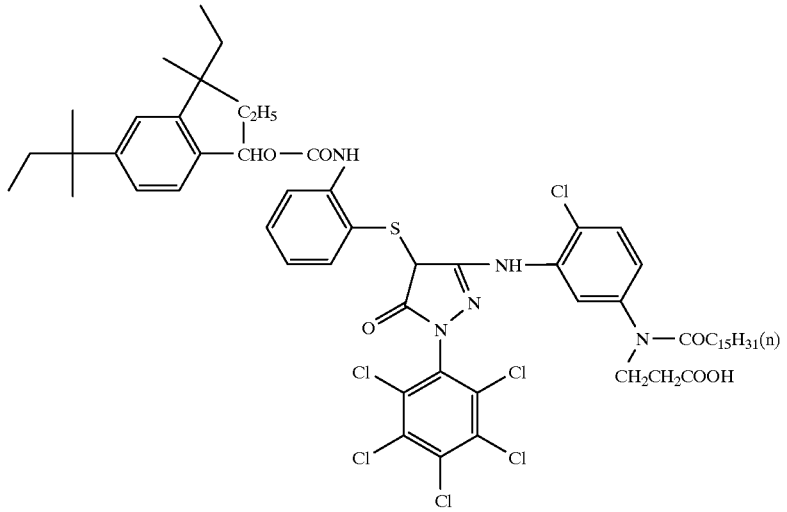
M-6
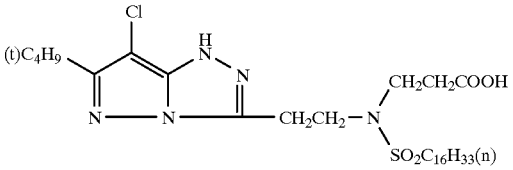
M-7
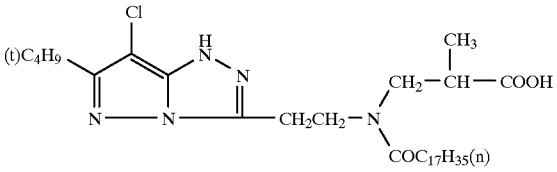
M-8
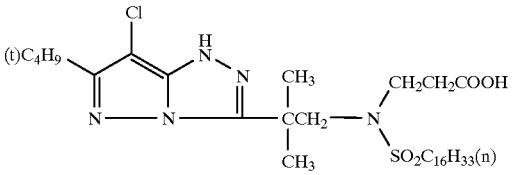
M-9
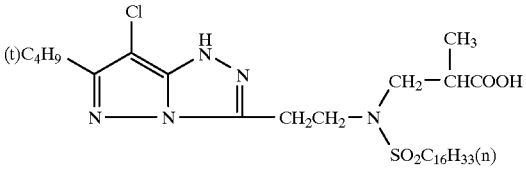
M-10
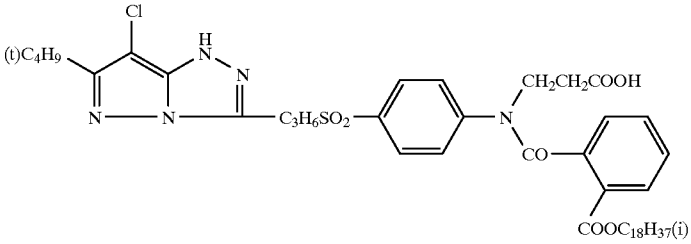

-continued
M-11
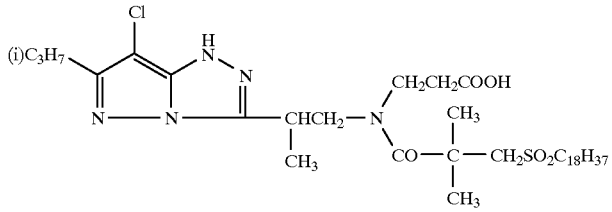
M-12
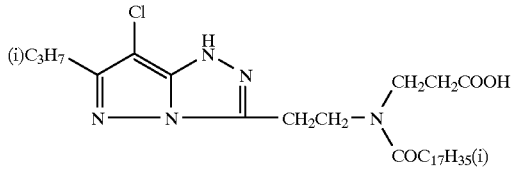
M-13
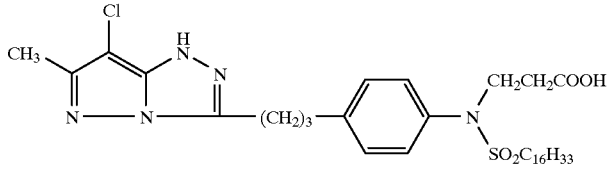
M-14
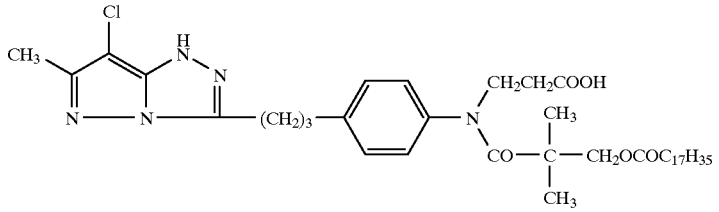
M-15
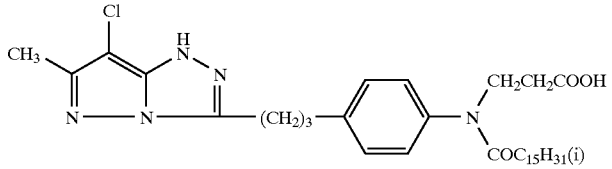
M-16
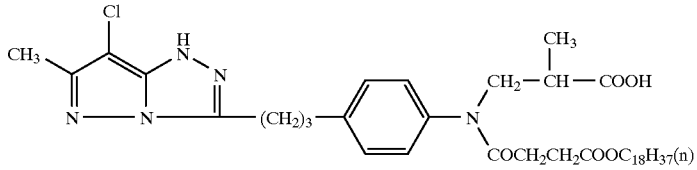
M-17
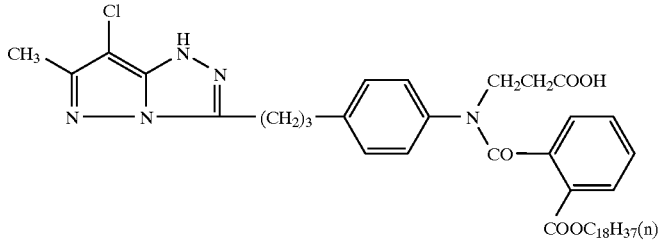

-continued
M-18
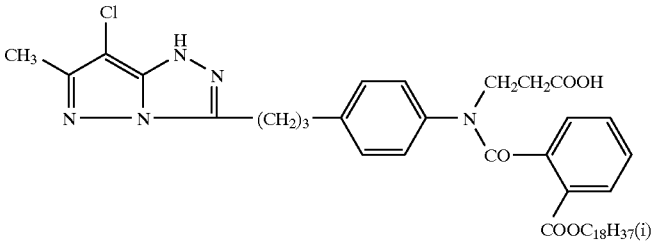
M-19
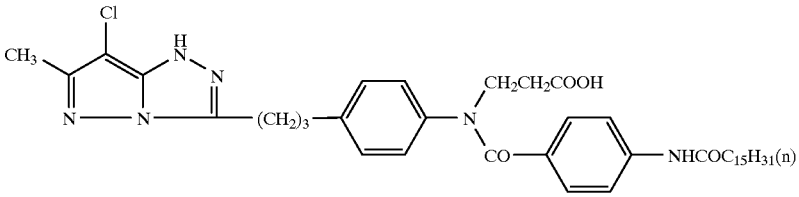
M-20
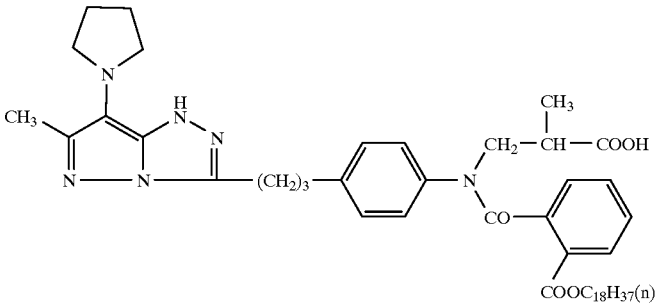
M-21
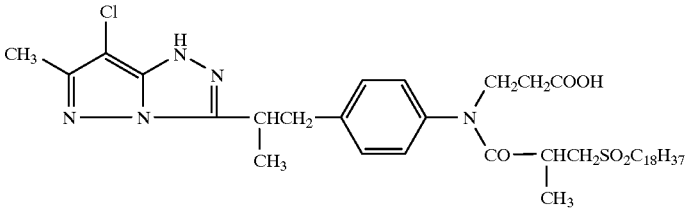
M-22
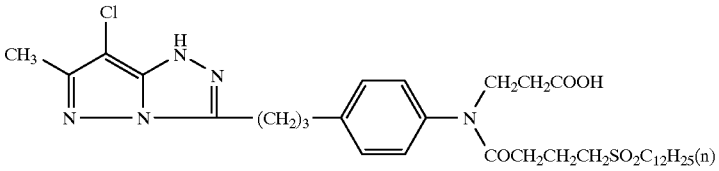
M-23
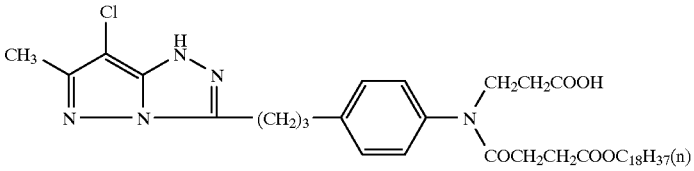
M-24
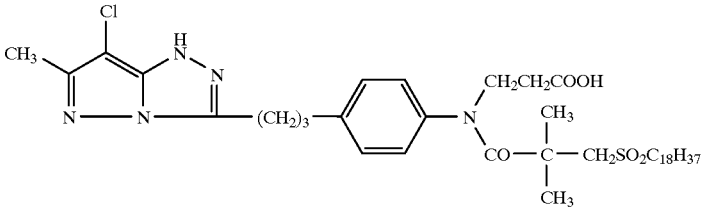

-continued
M-25
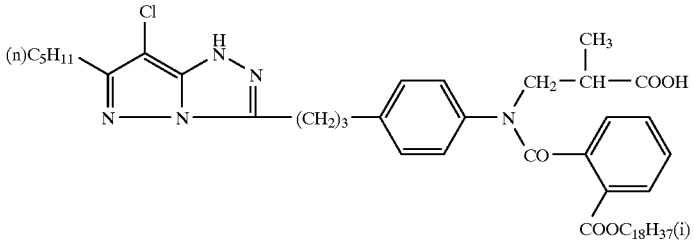
M-26
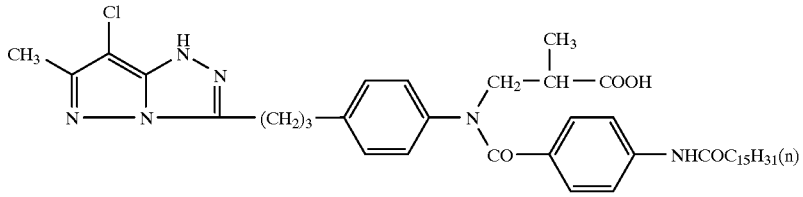
M-27
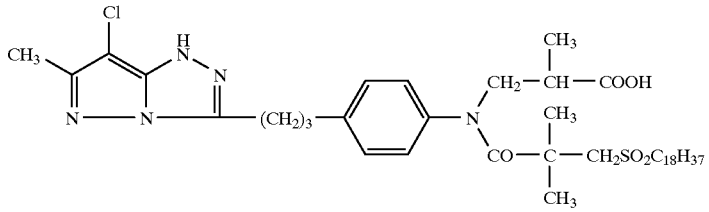
M-28
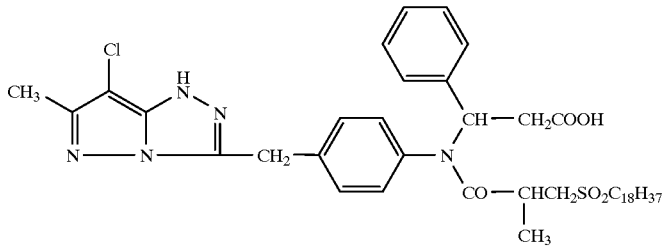
M-29
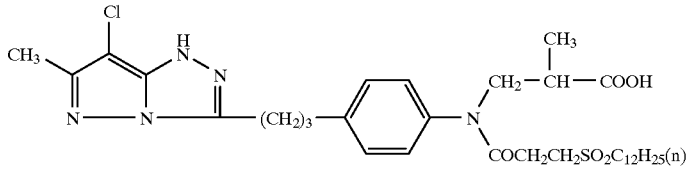
M-30
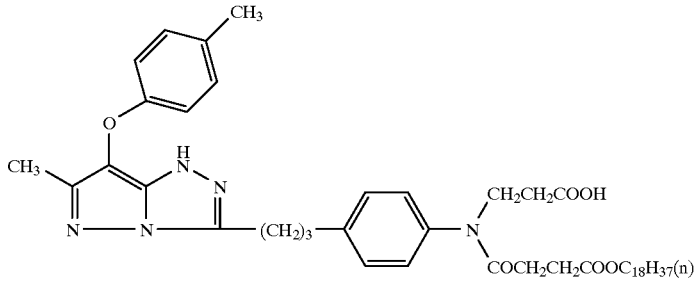

-continued
M-31
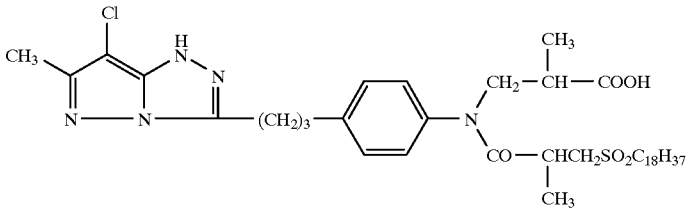
M-32
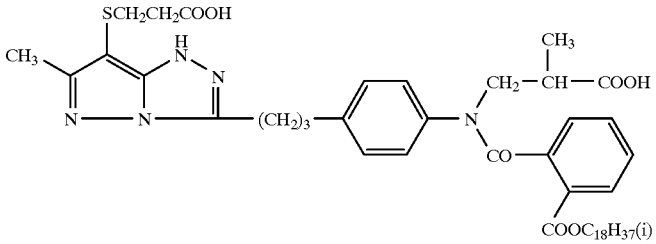
M-33
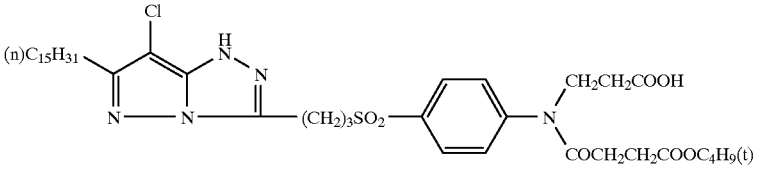
M-34
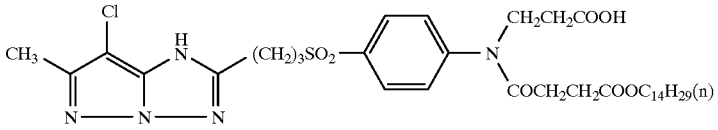
M-35
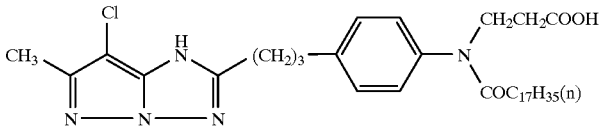
C-1
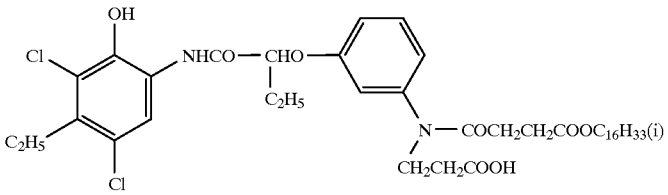
C-2
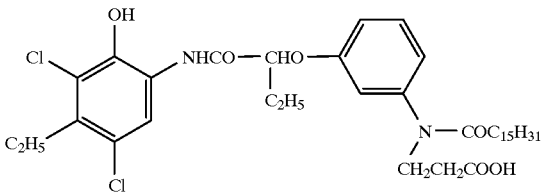
C-3
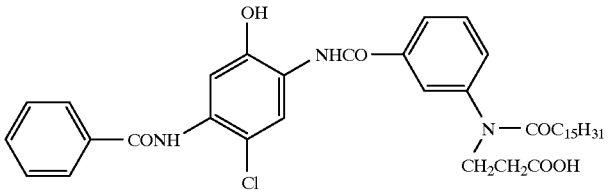

-continued
C-4
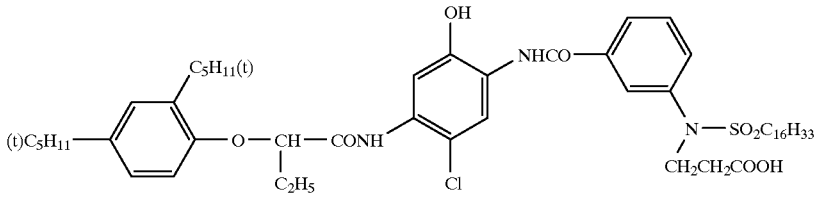
C-5
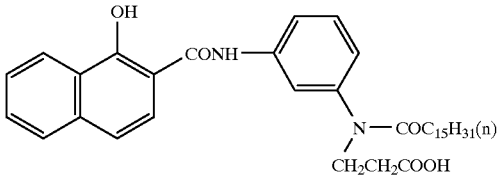
C-6
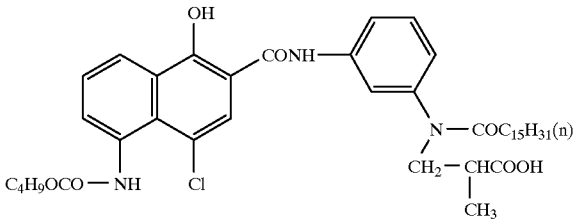
C-7
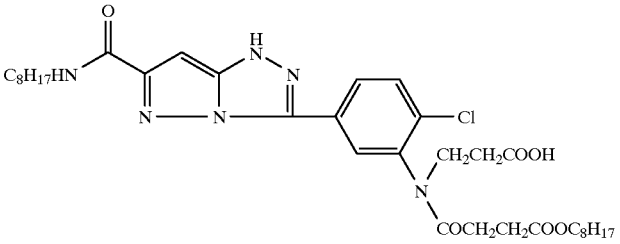
C-8
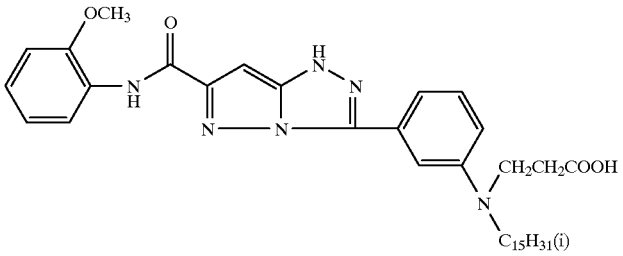
C-9
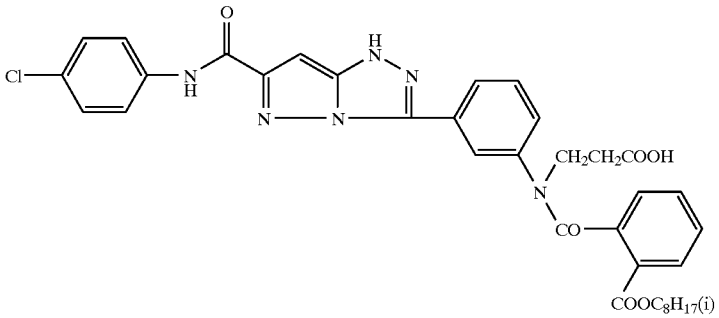

-continued

C-10

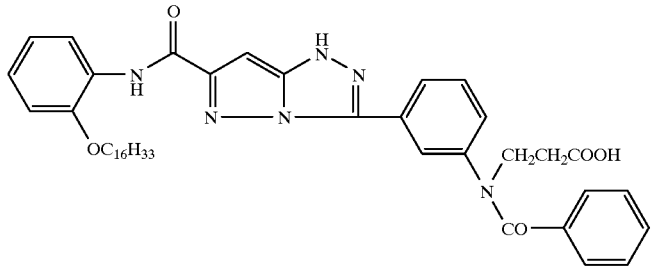

C-11

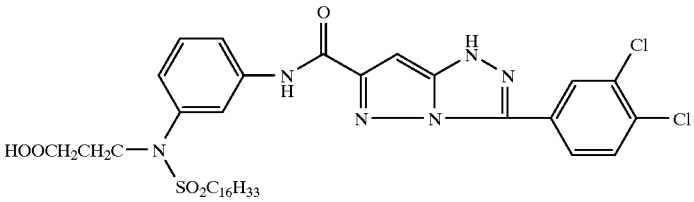

The synthesis example of a typical compound represented by formula (I) will be shown below.

(Synthesis Example)

Exemplified compound (17) was synthesized according to the following scheme:

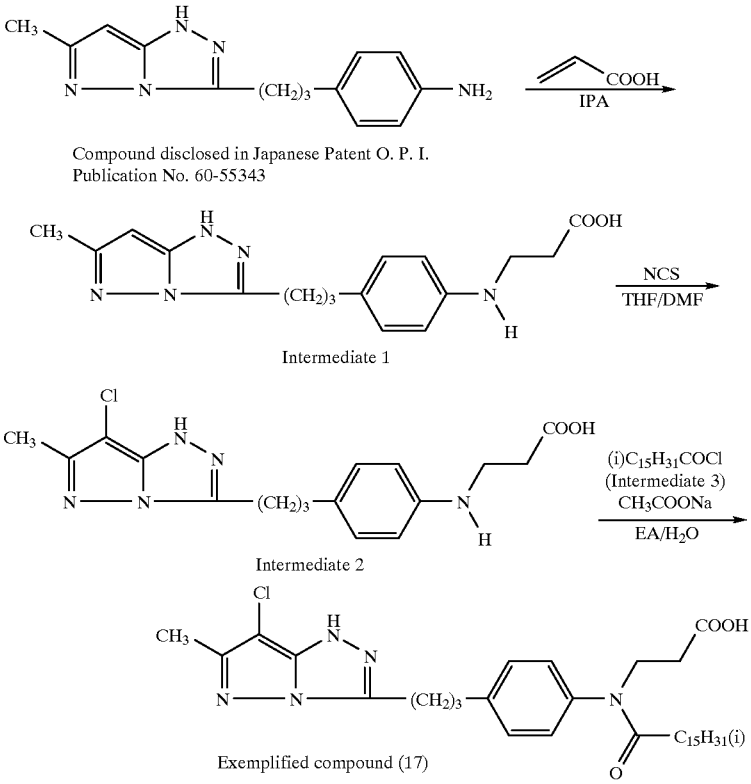

I) Synthesis of Intermediate 1

In 100 ml of isopropyl alcohol (IPA), 9.85 g of a compound in Japanese Patent O.P.I. Publication No. 60-55343 and 11.1 g of acrylic acid were dissolved, and refluxed for 6 hours. The resulting solution was cooled to produce precipitates. The yield was 10.3 g. The precipitates were identified as Intermediate 1 according to MASS, H-NMR and IR spectra.

II) Synthesis of Intermediate 2

In 35 ml of a mixture solvent of DMF:THF (=2:5), 9.45 g of Intermediate 1 were dissolved, and cooled to 5° C. To the resulting solution 4.26 g of N-chloro-Succinimide (NCS) were gradually added maintaining at 5° C., and stirred for 1 hour. The resulting solution was added with 100 ml of water to produce precipitates. The yield was 9.2 g. The precipitates were identified as Intermediate 2 according to MASS, H-NMR and IR spectra.

III) Synthesis of Exemplified compound (17)

Five grams of Intermediate 2 were dissolved in 75 ml of ethyl acetate, and added with 75 ml of water and 1.7 g of sodium acetate. The resulting solution was cooled to 10° C. and gradually added with 4.00 g of Intermediate 3 over 15 minutes. After the addition, the solution was returned to room temperature while stirring and stirred for additional one hour. The solution was extracted with ethyl acetate, neutralized, washed with water and dried. The solvent of the resulting solution was removed under reduced pressure and the resulting residue was recrystallized from 25 ml of a mixture solvent of ethyl acetate and acetonitrile to obtain crystals. The yield was 7.22 g. The crystals were identified as Exemplified compound (17) according to MASS, H-NMR and IR spectra.

Other couplers in the invention can be synthesized in a similar manner as above.

In the invention, the coupler content is usually $1\times10^{-3}$ to 1 mol, preferably $1\times10^{-2}$ to $8\times10^{-1}$ mol per mol of silver halide.

The coupler in the invention can be used in combination with other couplers.

The coupler in the invention is incorporated in a silver halide emulsion and the emulsion is coated on a support to obtain a silver halide color photographic light sensitive material.

The coupler is used in a color photographic light sensitive material such as a photographic negative or positive film or a photographic color print.

The light sensitive material such as color print employing the coupler in the invention may be monochromatic or multicolored. In a multicolor light sensitive material, the coupler in the invention may be contained in any layer. The multicolor light sensitive material comprises dye image forming component layers having sensitivities to each of three primary colors of spectra. Each component layer is comprised of a single-layerd or multi-layered emulsion layer sensitive to a specific spectrum region. A photographic component layer including the dye image forming component layers can be arranged in various orders as well known in the art.

The typical multicolor light sensitive material has, on a support, a cyan dye image forming layer comprising at least one red sensitive silver halide emulsion layer containing at least one cyan coupler, a magenta dye image forming layer comprising at least one green sensitive silver halide emulsion layer containing at least one magenta coupler, and a yellow dye image forming layer comprising at least one blue sensitive silver halide emulsion layer containing at least one yellow coupler.

The light sensitive material can comprises additional layers such as a filter layer, an intermediate layer, a protective layer and a subbing layer.

The coupler in the invention is incorporated in silver halide emulsion layers according to a conventional method. The conventional method comprises the steps of dissolving a coupler in a high boiling point solvent having a boiling point of 175° C. or more such as dibutylphthalate or tricresylphosphate, a low boiling point solvent such as butyl acetate or butyl propionate or a mixture solvent thereof, mixing the solution with a gelatin solution containing a surfactant, dispersing the resulting solution using a high speed rotating mixer, or a colloid mill, and incorporating the resulting dispersion into a silver halide emulsion to obtain a silver halide emulsion used in the invention.

The silver halide composition preferably used in the light sensitive material employing the coupler in the invention is silver chloride, silver bromochloride or silver iodobromochloride. The composition may be a mixture of silver chloride and silver bromide. When a silver halide emulsion is used in a color print, the silver halide preferably contains chlorine, and is more preferably silver chloride, or silver bromochloride or silver bromoiodochloride containing at least 1 mol % of silver chloride, since rapid development is required.

The silver halide emulsion is chemically sensitized by a conventional method, and can be spectrally sensitized to a desired light wavelength region.

A compound well known as an anti-foggant or a stabilizing agent can be added to the silver halide emulsion in order to prevent fog during the manufacture, storage or development processing of the light sensitive material, and/or to maintain storage stability of photographic properties.

Various additives such as an anti-foggant, a dye image stabilizer, a UV absorbent, an anti-static agent, a matting agent or a surfactant usually used in light sensitive material can be also added to the color light sensitive material employing the coupler in the invention.

These additives are described in Research Disclosure 176, p. 22–31 (December 1978).

The color light sensitive material employing the coupler in the invention can be processed according to a processing method well known in the art to obtain an image.

The color light sensitive material employing the coupler in the invention, which further contains a color developing agent or its precursor in the hydrophilic colloid layer, can be processed in an alkaline active bath.

The color light sensitive material employing the coupler in the invention is color developed, bleached and fixed. The bleaching and fixing may be carried out at the same time.

After fixing, water washing is carried out. Stabilizing may be carried out instead of the washing, and the water washing and stabilizing may be used in combination.

The invention will be explained according to the following examples, but is not limited thereto.

EXAMPLE 1

Both surfaces of paper were laminated with polyethylene to prepare a paper support. The following coating layers were are coated on the paper support in sequence from the support to obtain a green sensitive color light sensitive material sample 1. The added amount of compounds was represented in terms of amount per $m^2$ of the materials, unless otherwise specified. (Silver halide is represented in terms of silver.)

First layer: Emulsion layer

Emulsion containing 1.4 g of gelatin, 0.17 mole of a green sensitive silver bromochloride emulsion (containing 99.5 mol % of silver chloride), and $7.5\times10^{-4}$ mol of Comparative coupler 1 dissolved in 0.26 g of dioctylphthalate.

Second layer: Protective layer

Protective layer containing 0.50 g of gelatin, which contained 0.017 g of 2,4-dichloro-6-hydroxy-s-triazine sodium salt per 1 g of gelatin as a hardener.

Thus, light-sensitive material sample 1 was prepared. Next, light-sensitive material samples 2 through 8 were prepared in the same manner as in sample 1, except that couplers as shown in Table 1 were added in the equimolecular amount instead of Comparative coupler 1.

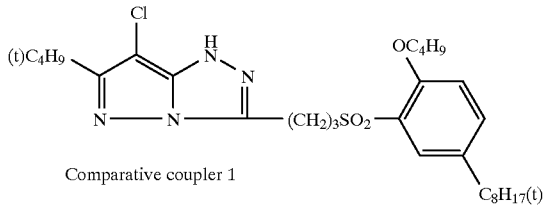

Comparative coupler 1

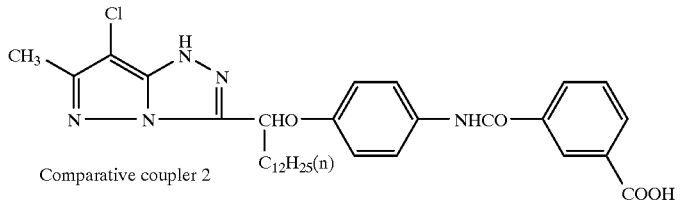

Comparative coupler 2

The resulting samples were wedge exposed to a green light according to a conventional method, and processed according to the following procedures:

| Processing step | Processing temperature | Time |
|---|---|---|
| Color developing | 35.0 ± 0.3° C. | 45 seconds |
| Bleach-fixing | 35.0 ± 0.5° C. | 45 seconds |
| Stabilizing | 30–34° C. | 90 seconds |
| Drying | 60–80° C. | 60 seconds |

The replenishing amount of replenishers was 80 cc per $m^2$ of color light sensitive material sample.

The compositions of the processing solutions were as follows:

| Color developer and color developer replenisher | | |
|---|---|---|
| Color developer | Color developer (tank solution) | Color developer replenisher |
| Pure water | 800 ml | 800 ml |
| Triethanolamine | 10.0 g | 18.0 g |
| N,N'-Diethylhydroxylamine | 5.0 g | 9.0 g |
| Potassium chloride | 2.4 g | |
| 1-Hydroxyethylidene-1,1-diphosphonic acid | 1.0 g | 1.8 g |
| N-Ethyl-N-(β-methanesulfonamidoethyl)-3-methyl-4-aminoaniline sulfate | 5.4 g | 8.2 g |
| Fluorescent brightening agent (4,4-diaminostylbenzsulfonate derivative) | 1.0 g | 1.8 g |
| Potassium carbonate | 27 g | 27 g |

Water was added to make 1000 ml in total. The pH's of color developer and color developer replenisher were regulated to 10.10 and 10.60, respectively.

| Bleach fixer (Bleach fixer replenisher) | |
|---|---|
| Ethylenediamine tetraacetate ferric ammonium dihydrate | 60 g |
| Ethylenediamine tetraacetic acid | 3 g |
| Ammonium thiosulfate (70% aqueous solution) | 100 cc |
| Ammonium sulfite (40% aqueous solution) | 27.5 cc |

Water was added to make 1000 ml in total, and the bleach-fixer and bleach-fixer replenisher was regulated to pH of 5.7 with potassium carbonate or glacial acetic acid.

| Stabilizer (Stabilizer replenisher) | |
|---|---|
| 5-Chloro-2-methyl-4-isothiazoline-3-on | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Aqueous ammonium hydroxide solution (20%) | 3.0 g |
| Fluorescent brightening agent (4,4'-diamino-styrylbenzene sulfonic acid derivative) | 1.5 g |

Water was added to make 1000 ml in total, and pH was regulated to 7.0 with a sulfuric acid or potassium hydroxide solution.

The processed samples

The maximum density (Dmax) of each of the processed samples 1 through 8 was measured using a densitometer Type KD-7 (produced by Konica Corporation). Further, the reflection sectrum of each sample was measured at a portion which gives density of 1.0, and absorption maximum wavelength λmax and $\Delta\lambda_L 0.2$ were determined. $\Delta\lambda_L 0.2$ is represented by $\lambda_L 0.2$–λmax, wherein $\lambda_L 0.2$ is a wavelength giving an optical density of 0.2 in the wavelength region longer than λmax, when optical density at λmax is normalized to 1.

TABLE 1

| Sample No. | Coupler used | Dmax | λmax | $\Delta\lambda_L 0.2$ |
|---|---|---|---|---|
| 1 (Comparative) | Comparative coupler 1 | 1.76 | 545 | 88 |
| 2 (Comparative) | Comparative coupler 2 | 1.88 | 547 | 81 |
| 3 (Inventive) | Exemplified compound (M-6) | 1.92 | 545 | 79 |
| 4 (Inventive) | Exemplified compound (M-10) | 1.91 | 544 | 80 |
| 5 (Inventive) | Exemplified compound (M-11) | 2.13 | 546 | 75 |
| 6 (Inventive) | Exemplified compound (M-12) | 2.11 | 545 | 76 |
| 7 (Inventive) | Exemplified compound (M-19) | 2.24 | 545 | 71 |
| 8 (Inventive) | Exemplified compound (M-25) | 2.26 | 546 | 72 |

As is apparent from Table 1, samples employing the coupler in the invention have a high Dmax, which shows superior dye forming property, and a small $\lambda_L$0.2, which shows a sharp absorption in the longer wavelength region, as compared with Comparative samples employing the comparative coupler 2. The coupler in the invention provides the excellent effects.

EXAMPLE 2

One surface of a paper sheet was laminated with a polyethylene layer and the other surface was laminated with a polyethylene layer containing titanium oxide to prepare a paper support. The following coating layers were coated on the titanium dioxide containing polyethylene layer of the paper support to prepare a multi-layered silver halide color photographic light-sensitive material Sample No. 9. The coating solution was prepared as shown in the following:

To 26.7 g of yellow coupler (EY-1), 10.0 g of dye image stabilizer (ST-1), 6.67 g of dye image stabilizer (ST-2), 0.67 g of additive (HQ-1), anti-irradiation dye (AI-3), and 6.67 g of high boiling organic solvent (DNP), 60 ml of ethyl acetate were added and dissolved. The solution was emulsified and dispersed into 220 ml of a 10% aqueous gelatin solution containing 7 ml of 20% surfactant (SU-1) by the use of a supersonic homogenizer to prepare a yellow coupler dispersion solution. This dispersion solution was mixed with the blue sensitive silver halide emulsion (containing 8.68 g of silver) prepared according to the following to prepare a first layer coating solution.

The 2nd layer through 7th layer coating solutions were prepared in the same manner as in the above-mentioned coating solution.

In addition, as a hardener, (H-1) was added to the second and fourth layers, and (H-2) was added to the seventh layer. As a coating aid, surfactants SU-2 and SU-3 were added to adjust a surface tension. The addition amount in the silver halide photographic light sensitive material is represented in terms of g/m$^2$, unless otherwise specified.

TABLE 2

| Layer | Structure | Added amount (g/m$^2$) |
|---|---|---|
| 7th layer (Protective layer) | Gelatin | 1.00 |
| | DIDP | 0.005 |
| | Additive (HQ-2) | 0.002 |
| | Additive (HQ-3) | 0.002 |
| | Additive (HQ-4) | 0.004 |
| | Additive (HQ-5) | 0.02 |
| | Compound (F-1) | 0.002 |
| 6th layer (UV absorbing layer) | Gelatin | 0.40 |
| | UV absorber (UV-1) | 0.10 |
| | UV absorber (UV-2) | 0.04 |
| | UV absorber (UV-3) | 0.16 |
| | Anti-stain Agent (HQ-5) | 0.04 |
| | DNP | 0.20 |
| | PVP | 0.03 |
| | Anti-irradiatin agent (AI-2) | 0.02 |
| | Anti-irradiatin agent (AI-4) | 0.01 |
| 5th layer (Red sensitive layer) | Gelatin | 1.30 |
| | Red sensitive silver bromochloride emulsion (Em-R) | 0.21 |
| | Cyan coupler (EC-1) | 0.24 |

TABLE 2-continued

| Layer | Structure | Added amount (g/m$^2$) |
|---|---|---|
| | Cyan coupler (EC-2) | 0.08 |
| | Dye image stabilizer (ST-1) | 0.20 |
| | Anti-stain agent (HQ-1) | 0.01 |
| | HBS-1 | 0.20 |
| | TCP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Anti-stain agent (HQ-5) | 0.10 |
| | DNP | 0.40 |

TABLE 3

| Layer | Structure | Added amount (g/m$^2$) |
|---|---|---|
| 3rd layer (Green sensitive layer) | Gelatin | 1.40 |
| | Green sensitive silver bromochloride emulsion (Em-G) | 0.17 |
| | Magenta coupler (EM-1) | 0.75* |
| | Dye image stabilizer (ST-3) | 0.20 |
| | Dye image stabilizer (ST-4) | 0.17 |
| | DIDP | 0.13 |
| | DNP | 0.13 |
| | Anti-irradiatin agent (AI-1) | 0.01 |
| 2nd layer (Intermediate layer) | Gelatin | 1.20 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.06 |
| | Compound (F-1) | 0.002 |
| 1st layer (Blue sensitive layer) | Gelatin | 1.20 |
| | Blue sensitive silver bromochloride emulsion (Em-B) | 0.26 |
| | Yellow coupler (EY-1) | 0.80 |
| | Dye image stabilizer (ST-1) | 0.30 |
| | Dye image stabilizer (ST-2) | 0.20 |
| | Anti-stain agent (HQ-1) | 0.02 |
| | Anti-irradiatin agent (AI-3) | 0.01 |
| | DNP | 0.20 |
| Support | Paper laminated with polyethylene | |

"*" represents mmol/m$^2$.

The added amount of the silver halide emulsion is illustrated in terms of silver.

EY-1
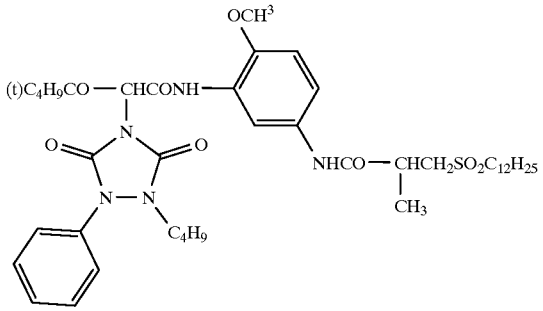
EC-1
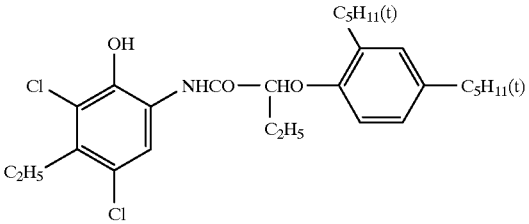
EC-2
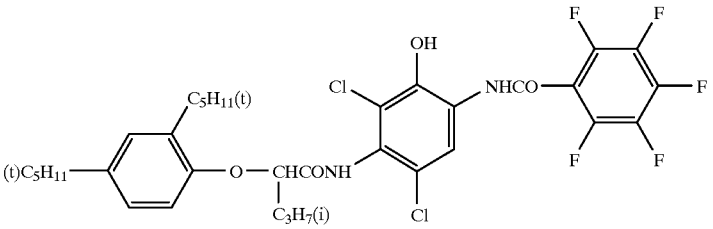
EM-1
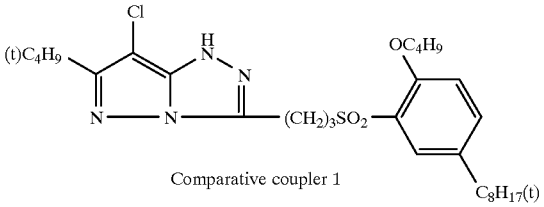
Comparative coupler 1
EM-2
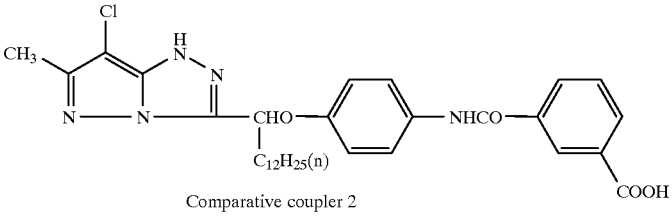
Comparative coupler 2
ST-1
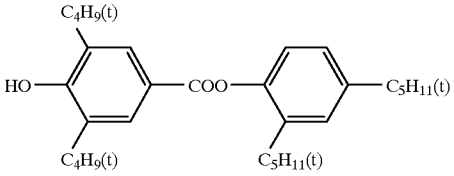
ST-2
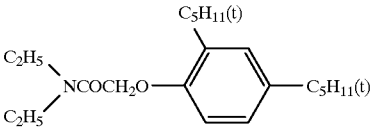

-continued
ST-3
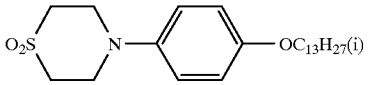
ST-4
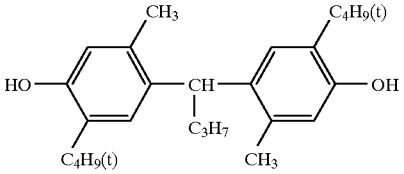
UV-1
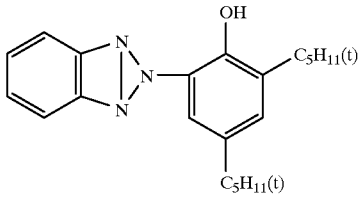
UV-2
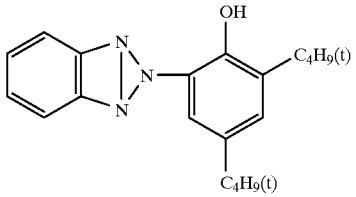
UV-3
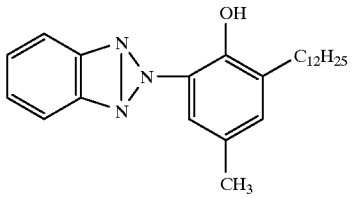
DBP: Dibutylphthalate
TCP: Tricresyl phosphate
DIDP: Diisodecylphthalate
DNP: Dinonylphthalate
PVP: Polyvinylpyrrolidone
HQ-1
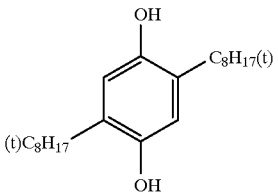
HQ-2
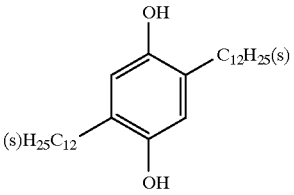

-continued
HQ-3
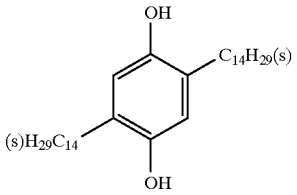
HQ-4
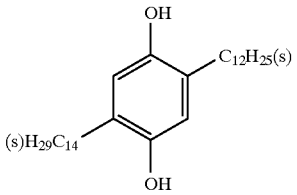
HQ-5
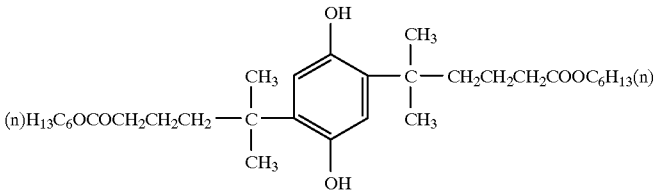
HBS-1
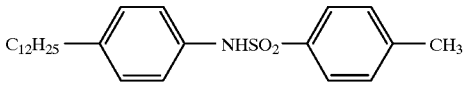
AI-1
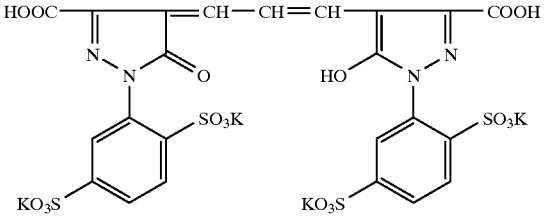
AI-2
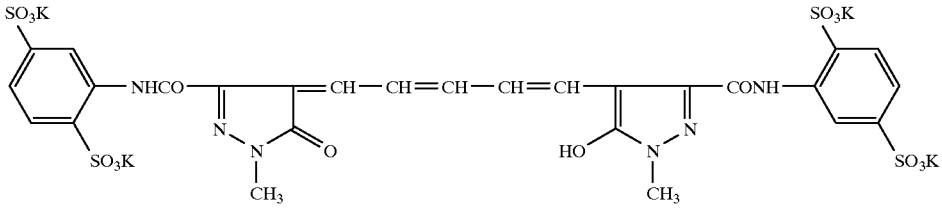
AI-3
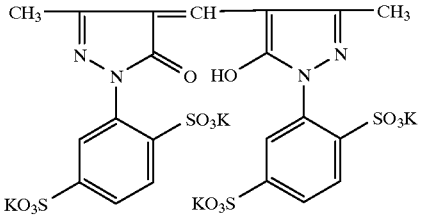

-continued

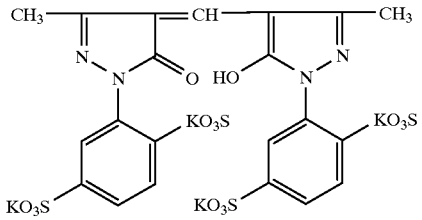

AI-4

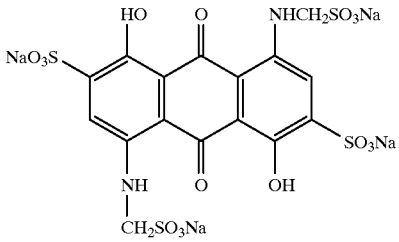

SU-1

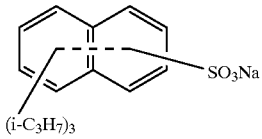

SU-2

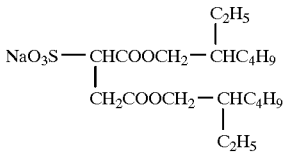

SU-3

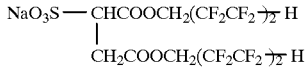

H-1

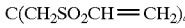

H-2

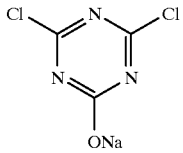

F-1

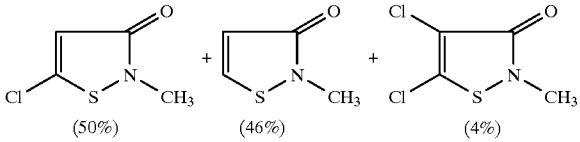

(50%) (46%) (4%)

mole ratio (Preparation of blue sensitive silver halide emulsion)

To 1000 ml of a 2% aqueous gelatin solution kept at 40° C., the following Solutions A and B were concurrently added spending 30 minutes while pAg was controlled to 6.5 and pH was controlled to 3.0, and then, the following Solution C and D were concurrently added spending 180 minutes while pAg as controlled to 7.3 and pH was controlled to 5.5. The pH was controlled with an aqueous sulfuric acid or sodium hydroxide solution. The pAg was adjusted using an aqueous halide solution of sodium chloride and potassium bromide in which the content ratio (by mole) of the chloride ion to the bromide ion is 99.8:0.2. When solutions A and B were mixed, a solution having a halide concentration of 0.1 mol per liter was used, and when solutions C and D were mixed, a solution having a halide concentration of 1 mol per liter was used.

| (Solution A) | |
|---|---|
| Sodium chloride | 3.42 g |
| Potassium bromide | 0.03 g |
| Water was added to make a 200 ml solution. | |

-continued

| | |
|---|---|
| (Solution B) | |
| Sodium nitrate | 10 g |
| Water was added to make a 200 ml solution. | |
| (Solution C) | |
| Sodium chloride | 102.7 g |
| Potassium bromide | 1.0 g |
| Water was added to make a 600 ml solution. | |
| (Solution D) | |
| Sodium nitrate | 300 g |
| Water was added to make a 600 ml solution. | |

After the addition was completed, the solution was subjected to desalting by the use of a 5% aqueous solution of Demol N produced by Kao Atlas Co., Ltd. and a 20% aqueous solution of magnesium sulfate, and was mixed with an aqueous gelatin solution. Mono-dispersed cubic emulsion EMP-1 was prepared which had an average grain size of 0.85 $\mu$m, a variation coefficient of grain size distribution of 0.07 and a silver chloride content of 99.5 mol %.

The above-obtained emulsion EMP-1 was subjected to chemical sensitization at 50° C. for 90 minutes employing the following compounds. Thus, a blue sensitive silver halide emulsion (Em-B) was obtained.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizer BS-1 | $4 \times 10^{-4}$ mol/mol AgX |
| Sensitizer BS-2 | $1 \times 10^{-4}$ mol/mol AgX |

(Preparation of green sensitive silver halide emulsion)

The mono-dispersed cubic emulsion EMP-2 was prepared in the same manner as in EMP-1, except that the addition time of Solutions A And B, and the addition time of Solutions C And D were varied. The emulsion EMP-2 had an average grain size of 0.43 $\mu$m, a variation coefficient of 0.08 and a silver chloride content of 99.5 mol %.

The above-obtained emulsion EMP-2 was subjected to chemical sensitization at 55° C. for 120 minutes employing the following compounds. Thus, a green sensitive silver halide emulsion (Em-G) was obtained.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizer GS-1 | $4 \times 10^{-4}$ mol/mol AgX |

(Preparation of red sensitive silver halide emulsion)

The mono-dispersed cubic emulsion EMP-3 was prepared in the same manner as in EMP-1, except that the addition time of Solutions A And B, and the addition time of Solutions C And D were varied. The emulsion EMP-3 had an average grain size of 0.50 $\mu$m, a variation coefficient of 0.08 and a silver chloride content of 99.5 mol %.

The above-obtained emulsion EMP-3 was subjected to chemical sensitization at 60° C. for 90 minutes employing the following compounds. Thus, a red sensitive silver halide emulsion (Em-R) was obtained.

| | |
|---|---|
| Sodium thiosulfate | 1.8 mg/mol AgX |
| Chloroauric acid | 2.0 mg/mol AgX |
| Stabilizer STAB-L | $6 \times 10^{-4}$ mol/mol AgX |
| Sensitizer RS-1 | $1 \times 10^{-4}$ mol/mol AgX |

The variation coefficient was obtained by dividing the grain size standard deviation by the average grain size employing 100 silver halide grains in the electromicroscope photograph.

BS-1

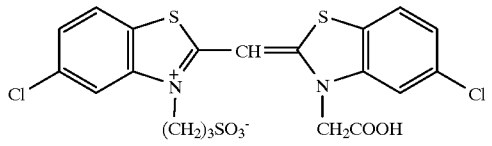

BS-2

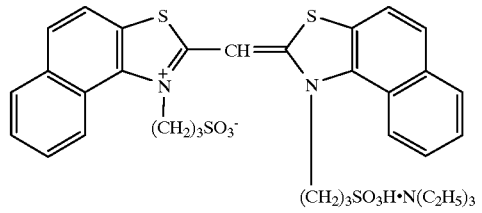

GS-1

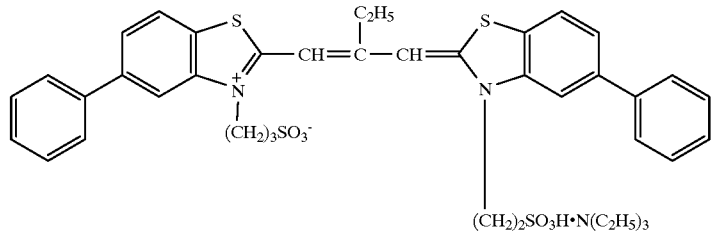

-continued

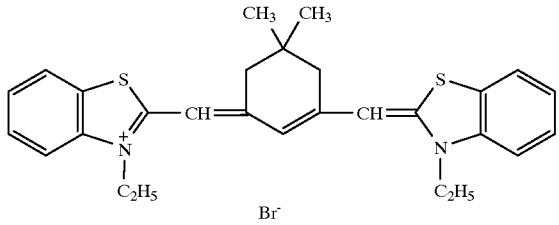

RS-1

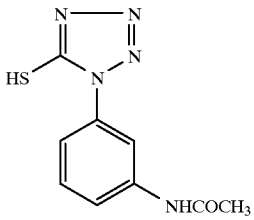

STAB-1

Thus, light-sensitive material sample 9 was prepared. Next, light-sensitive material samples 10 through 20 were prepared in the same manner as in sample 9, except that the couplers as shown in Table 4 were added in the equimolecular amount instead of Comparative coupler 1 (of EM-1).

The resulting samples were wedge exposed, processed and evaluated for Dmax, λmax, and $\Delta\lambda_L 0.2$ in the same manner as in Example 1. The results are shown in Table 4.

TABLE 4

| Sample No. | Coupler used | Dmax | λmax | $\Delta\lambda_L 0.2$ |
|---|---|---|---|---|
| 9 (Comparative) | Comparative coupler 1 | 1.72 | 545 | 90 |
| 10 (Comparative) | Comparative coupler 2 | 1.86 | 547 | 83 |
| 11 (Inventive) | Exemplified compound (M-7) | 1.92 | 545 | 81 |
| 12 (Inventive) | Exemplified compound (M-9) | 1.91 | 544 | 82 |
| 13 (Inventive) | Exemplified compound (M-13) | 2.20 | 547 | 73 |
| 14 (Inventive) | Exemplified compound (M-15) | 2.22 | 544 | 72 |
| 15 (Inventive) | Exemplified compound (M-17) | 2.29 | 545 | 72 |
| 16 (Inventive) | Exemplified compound (M-21) | 2.26 | 546 | 74 |
| 17 (Inventive) | Exemplified compound (M-23) | 2.24 | 545 | 73 |
| 18 (Inventive) | Exemplified compound (M-24) | 2.24 | 546 | 73 |
| 19 (Inventive) | Exemplified compound (M-26) | 2.21 | 546 | 74 |
| 20 (Inventive) | Exemplified compound (M-29) | 2.25 | 545 | 73 |

As is apparent from Table 4, samples employing the coupler in the invention have a high Dmax, which shows superior dye forming property, and a small $\lambda_L 0.2$, which shows superior color reproduction, as compared with Comparative samples employing comparative coupler 1 or 2.

EXAMPLE 3

Light-sensitive material samples 21 through 24 were prepared in the same manner as in sample 9 of Example 2, except that couplers as shown in Table 1 were added in the equimolecular amount instead of Comparative coupler 1 (EM-1) in the third layer. The resulting samples were wedge exposed, processed and evaluated for Dmax of the green sensitive layer in the same manner as in Example 1. Next, Color reproduction performance was evaluated by comparing the samples by visual observation after taking the Macbeth Color Chart (produced by Macbeth Co., Ltd.) using Konica Color DD100 (produced by Konica Corporation) and printing them on the samples. Evaluation was made in five grades as follows:

5:Excellent, 4:Good, 3:Fair, 2:Poor, 1:Very poor

The results are shown in Table 5.

Comparative coupler 3

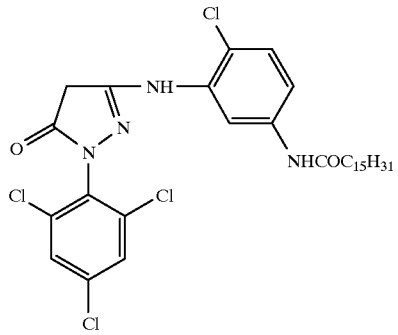

TABLE 5

| Sample No. | Coupler used | Dmax | Color Reproduction |
|---|---|---|---|
| 21 (Comparative) | Comparative coupler 3 | 1.76 | 2 |
| 22 (Inventive) | Exemplified compound M-1 | 2.12 | 4 |
| 23 (Inventive) | Exemplified compound M-3 | 2.15 | 4 |
| 24 (Inventive) | Exemplified compound M-4 | 2.08 | 4 |

As is apparent from Table 5, inventive samples employing the coupler in the invention provide a high Dmax and superior color production, as compar 100 (produced by Konica Corpor

EXAMPLE 4

Light-sensitive material samples 25 through 28 were prepared in the same manner as in sample 9 of Example 2, except that couplers as shown in Table 6 were added in the equimolecular amount instead of couplers EC-1 and EC-2 in the fifth layer. The resulting samples were wedge exposed, processed and evaluated for Dmax of the red sensitive layer in the same manner as in Example 1. Next, Color reproduction performance was evaluated in the same manner as in Example 3. The results are shown in Table 6.

Comparative coupler 4

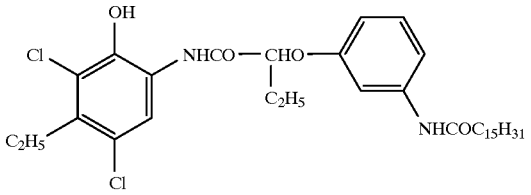

TABLE 6

| Sample No. | Coupler used | Dmax | Color Reproduction |
|---|---|---|---|
| 25 (Comparative) | Comparative coupler 4 | 1.82 | 3 |
| 26 (Inventive) | Exemplified compound C-1 | 2.13 | 5 |
| 27 (Inventive) | Exemplified compound C-3 | 2.20 | 4 |
| 28 (Inventive) | Exemplified compound C-4 | 2.15 | 5 |

As is apparent from Table 6, inventive samples employing the coupler in the invention provide a high Dmax and superior color reproduction, as compared with the Comparative sample.

EXAMPLE 5

Light-sensitive material samples 29 through 32 were prepared in the same manner as in sample 9 of Example 2, except that couplers as shown in Table 7 were added in the equimolecular amount instead of coupler EY-1 in the first layer. The resulting samples were wedge exposed, processed and evaluated for Dmax of the blue sensitive layer in the same manner as in Example 1. Next, Color reproduction performance was evaluated in the same manner as in Example 3. The results are shown in Table 7.

Comparative coupler 5

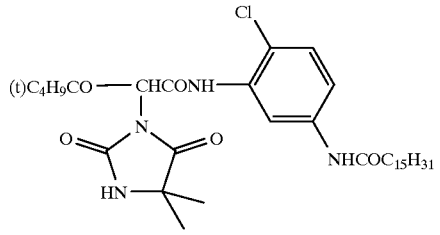

TABLE 7

| Sample No. | Coupler used | Dmax | Color Reproduction |
|---|---|---|---|
| 29 (Comparative) | Comparative coupler 5 | 1.82 | 3 |
| 30 (Inventive) | Exemplified compound Y-2 | 2.13 | 5 |
| 31 (Inventive) | Exemplified compound Y-3 | 2.20 | 4 |
| 32 (Inventive) | Exemplified compound Y-4 | 2.15 | 5 |

As is apparent from Table 7, inventive samples employing the coupler in the invention provide a high Dmax and superior color reproduction, as compared with the Comparative sample.

What is claimed is:

1. A silver halide color photographic light sensitive material comprising a coupler represented by the following formula (I):

formula (I)

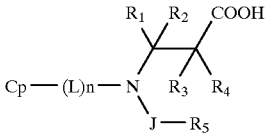

wherein Cp represents a coupler moiety; L represents a divalent linkage group derived from a 2 to 4 carbon alkyl group, an aralkyl group, an aryl group, an anilino group, an acylamino group, a sulfonamido group, an alkylthio group, an arylthio group, an alkenyl group, a cycloalkyl group, a cycloalkenyl group, an alkinyl group, a heterocyclic group, a sulfonyl group, a sulfinyl group, a phosphonyl group, an acyl group, a carbamoyl group, a sulfamoyl group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclicthio group or a combination thereof; J represents —CO— or —$SO_2$—; $R_1$, $R_2$, $R_3$ and $R_4$ independently represent a hydrogen atom, an alkyl group or an aryl group; $R_5$ represents a straight-chained or branched alkyl group having 1 to 32 carbon atoms, an aryl group, a heterocyclic group, a spiro compound residue or a closslinked hydrocarbon compound residue; and n represents 1.

2. The silver halide color photographic light sensitive material of claim 1, wherein said Cp represents an acylanilide yellow coupler moiety, a pyrazolone magenta coupler moiety, a pyrazoloazole magenta coupler moiety, a phenol cyan coupler moiety, a naphthol cyan coupler moiety or a pyrazolotriazole cyan coupler moiety.

3. The silver halide color photographic light sensitive material of claim 2, wherein said Cp represents a pyrazolotriazole magenta coupler moiety.

4. The silver halide color photographic light sensitive material of claim 3, wherein the coupler is represented by the following formula (II):

formula (II)

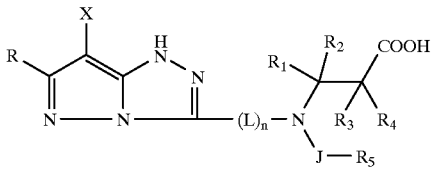

wherein L represents a divalent linkage group derived from a 2 to 4 carbon alkyl group, an aralkyl group, an aryl group, an anilino group, an acylamino group, a sulfonamido group, an alkylthio group, an arylthio group, an alkenyl group, a cycloalkyl group, a cycloalkenyl group, an alkinyl group, a heterocyclic group, a sulfonyl group, a sulfinyl group, a phosphonyl group, an acyl group, a carbamoyl group, a sulfamoyl group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclicthio group or a combination thereof; J represents —CO— or —$SO_2$—; $R_1$, $R_2$, $R_3$ and $R_4$ independently represent a hydrogen atom, an alkyl group or an aryl group; $R_5$ represents a straight-chained or branched alkyl group having 1 to 32 carbon atoms, an aryl group, a heterocyclic group, a spiro compound residue or a closslinked hydrocarbon compound residue; n represents 1; X represents a hydrogen atom or a group capable of being released upon reaction with an oxidation product of a color developing agent; and R represents an alkyl group, an aryl group, an anilino group, an acylamino group, a sulfonamido group, an alkylthio group, an arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a cyano group, an acyloxy group, an alkylamino group, an imido group, a ureido group, a sulfamoylamino group, an alkoxycarbonyl group, an aryloxycarbonyl group, a heterocyclicthio group, a spiro compound residue or a closslinked hydrocarbon compound residue.

5. The silver halide color photographic light-sensitive material of claim 4 wherein said divalent linkage group is an ethylene group, a isobutylene group, or a propylene group.

6. The silver halide color photographic light-sensitive material of claim 1 wherein said divalent linkage group is an ethylene group, a isobutylene group, or a propylene group.

7. A silver halide color photographic light sensitive material comprising a support and provided thereon, a silver halide emulsion layer containing a coupler represented by the following formula (I):

formula (I)

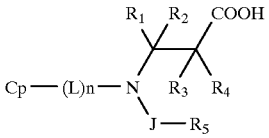

wherein Cp represents a coupler moiety; L represents a divalent linkage group derived from a 2 to 4 carbon alkyl group, an aralkyl group, an aryl group, an anilino group, an acylamino group, a sulfonamido group, an alkylthio group, an arylthio group, an alkenyl group, a cycloalkyl group, a cycloalkenyl group, an alkinyl group, a heterocyclic group, a sulfonyl group, a sulfinyl group, a phosphonyl group, an acyl group, a carbamoyl group, a sulfamoyl group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclicthio group or a combination thereof; J represents —CO— or —$SO_2$—; $R_1$, $R_2$, $R_3$ and $R_4$ independently represent a hydrogen atom, an alkyl group or an aryl group; $R_5$ represents a straight-chained or branched alkyl group having 1 to 32 carbon atoms, an aryl group, a heterocyclic group, a spiro compound residue or a closslinked hydrocarbon compound residue; and n represents 1.

8. The silver halide color photographic light-sensitive material of claim 7 wherein said divalent linkage group is an ethylene group, a isobutylene group, or a propylene group.

* * * * *